US011339562B2

(12) United States Patent
Heidenreich

(10) Patent No.: US 11,339,562 B2
(45) Date of Patent: May 24, 2022

(54) AREA-COVERING STRUCTURE MODULE

(71) Applicant: Bernd Heidenreich, Chorin (DE)

(72) Inventor: Bernd Heidenreich, Chorin (DE)

( * ) Notice: Subject to any disclaimer, the term of this patent is extended or adjusted under 35 U.S.C. 154(b) by 304 days.

(21) Appl. No.: 16/483,765

(22) PCT Filed: Feb. 19, 2018

(86) PCT No.: PCT/EP2018/000066

§ 371 (c)(1),
(2) Date: Aug. 6, 2019

(87) PCT Pub. No.: WO2018/149549

PCT Pub. Date: Aug. 23, 2018

(65) Prior Publication Data

US 2021/0293014 A1 Sep. 23, 2021

(30) Foreign Application Priority Data

Feb. 20, 2017 (DE) ..... 10 2017 001 551.1

(51) Int. Cl.
*E04B 1/19* (2006.01)
*E04B 1/32* (2006.01)

(52) U.S. Cl.
CPC ..... *E04B 1/19* (2013.01); *E04B 1/32* (2013.01); *E04B 2001/199* (2013.01); *E04B 2001/1975* (2013.01); *E04B 2001/1984* (2013.01)

(58) Field of Classification Search
CPC ..... E04B 1/19; E04B 2001/199; E04B 2001/1975; E04B 2001/1978;
(Continued)

(56) References Cited

U.S. PATENT DOCUMENTS 3,064,773 A * 11/1962 Linecker ..... E04B 5/10 52/521
3,389,513 A * 6/1968 Ruggles ..... E04C 2/32 52/82

(Continued)

FOREIGN PATENT DOCUMENTS

CH 551541 A * 7/1974 ..... E04G 11/52
CN 102174858 A 9/2011

(Continued)

*Primary Examiner* — Christine T Cajilig
(74) *Attorney, Agent, or Firm* — Laurence A. Greenberg; Werner H. Stemer; Ralph E. Locher

(57) ABSTRACT

A double-shelled load-bearing structure module of any geometric shape, is formed from top and bottom secondary shell elements. A double-shelled load-bearing structure in the form of a primary shell structure is joined with the module, made of individual assembled load-bearing structure modules of this kind having statically necessary filling rods. The secondary shell elements have, in each corner, a connection pocket, which is open at the top or bottom or is open at the top and bottom, of appropriate size for connecting a plurality of load-bearing structure modules. The connection pocket, at least on the outside, on the outer vertical surfaces of the secondary shell elements, is delimited by preferably metal profiles or metal sheet. Connection tabs can also be disposed in each corner instead of connection pockets. The connection tabs are formed from angular surfaces, preferably metal sheet, protruding towards the intermediate space between the secondary shell elements.

20 Claims, 12 Drawing Sheets

(58) Field of Classification Search
CPC .... E04B 2001/1984; E04B 7/10; E04B 7/102; E04B 7/107; E04B 7/026; E04B 1/32
See application file for complete search history.

(56) References Cited

U.S. PATENT DOCUMENTS

| | | | | |
|---|---|---|---|---|
| 4,723,384 | A | 2/1988 | Mengeringhausen et al. | |
| 5,031,371 | A * | 7/1991 | Davister | E04B 1/10 52/236.1 |
| 5,620,273 | A * | 4/1997 | Heyn | A47B 47/005 403/170 |
| 2003/0014928 | A1* | 1/2003 | Kerney | E04B 1/02 52/90.1 |
| 2009/0282766 | A1 | 11/2009 | Roen | |
| 2016/0032581 | A1* | 2/2016 | Sklar | E04B 1/1903 52/220.8 |
| 2019/0226198 | A1* | 7/2019 | Morgan | E04B 1/1903 |

FOREIGN PATENT DOCUMENTS

| | | | | |
|---|---|---|---|---|
| DE | 812466 | C * | 8/1951 | E04B 7/107 |
| DE | 2522037 | A1 * | 11/1976 | E04B 1/19 |
| DE | 3415344 | A1 | 11/1985 | |
| EP | 1609924 | A1 | 12/2005 | |
| FR | 776374 | A * | 1/1935 | E04B 7/102 |
| FR | 1238724 | A | 12/1960 | |
| GB | 1175711 | A | 12/1969 | |

* cited by examiner

AREA-COVERING STRUCTURE MODULE

BACKGROUND OF THE INVENTION

Field of the Invention

The invention concerns a double-shell area-covering structure module, in which double-shell area-covering structure modules in the form of primary shell structures are achieved from individual assembled elements, which, in the further description, are shortly referred to as primary shell structures.

From the CN 102 174 858 A, a prefabricated building system with steel grid structure consisting of wall plates, ceiling plates and supporting columns is known, which has special structures of the components and connection solutions between the components.

DE 3 415 344 A1 describes a quick-construction frame, especially made of steel, as a load-bearing structure for ceiling and wall panels of a building. This solution is known as skeleton structure, which is here equipped with special connection solutions of the rod components (supports, transoms) for quick assembly of the skeletons.

From EP 1 609 924 A1, inverted reinforced concrete cassette ceilings with crossed ribs in 3 planes are known. The lower level 1 is composed of a reinforced concrete slab, level 2 of ribs and recesses and level 3 of plates/tiles resting on crossing points of the ribs with elevation for the distribution of air-conditioned air or installation pipes. The ceiling elements rest on supports at their corners and are connected to each other by special devices.

GB 1,175,711 A describes crossed, parallel truss girders for ceiling and roof structures, intended as supporting structure.

US 2009/0282766 A1 is known for its prefabricated lattice sections made of crossed bending rods, laid on parallel, flat truss girders with parallel straps of the same or similar profiles as the lattice sections. The truss girders rest on the main supporting elements of the building (girders, walls) and the lattice honeycombs are covered by removable panels. Suspended ceilings achieved with this system are suspended from the flat truss girders or main load-bearing elements of the building, thus achieving almost full-surface accessibility to the space between the suspended grid ceiling and the suspended ceiling.

The disadvantage of all these known solutions is that no interaction of spaced surface elements is achieved with regard to the plate load-bearing effect and, in addition, that they are relatively heavy solutions.

SUMMARY OF THE INVENTION

The purpose of the invention is to propose a solution, which eliminates the disadvantages of the state of the art and economically produces primary shell structures by joining largely identical modules that are to be industrially prefabricated in series, and which, if required, can be installed in partially pre-assembled, easy-to-transport and easy-to assemble areas in a wide variety of geometries in buildings of different construction methods.

The solution according to the invention will be explained in the following by means of examples and figures.

DESCRIPTION OF THE INVENTION

Figure 1:
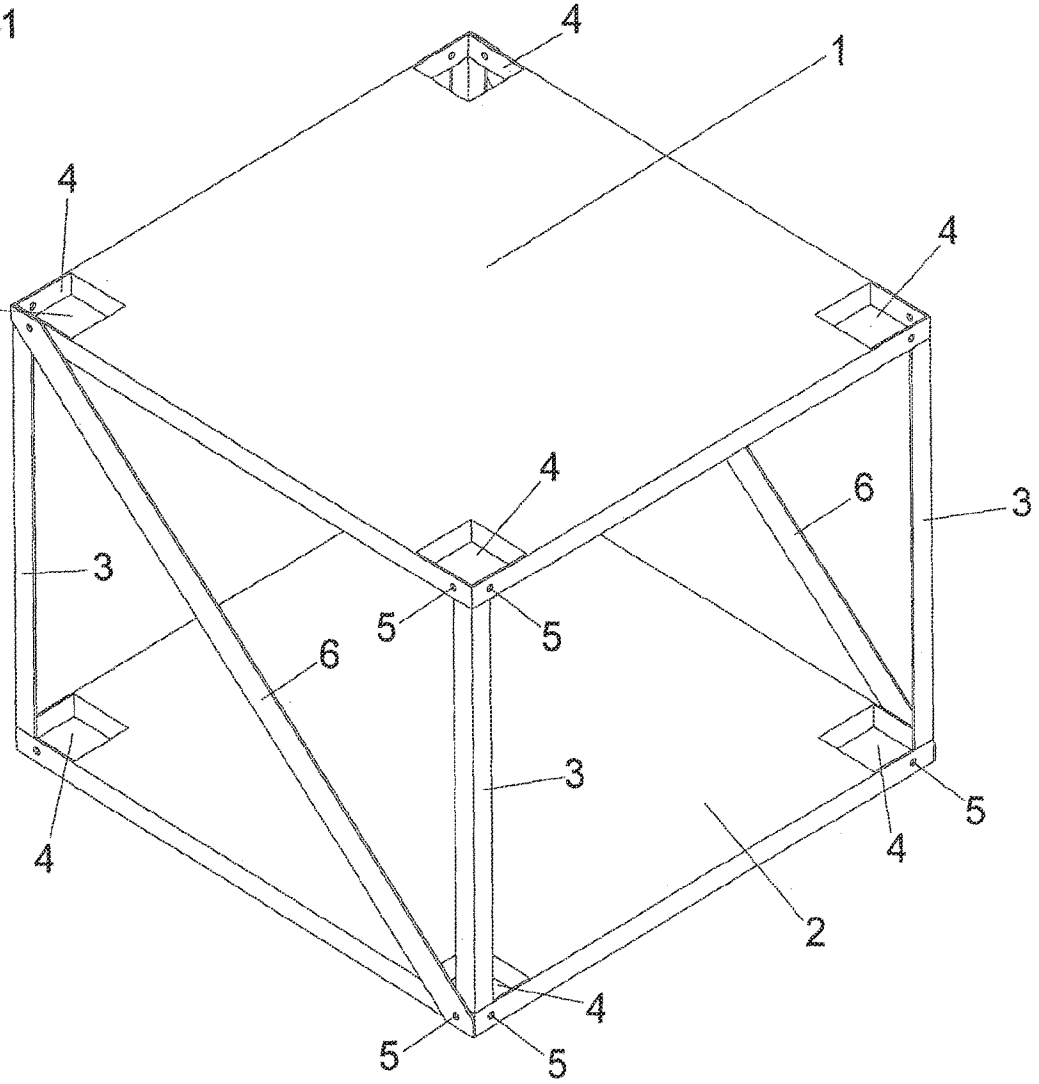
FIG. 1: isometric representation of a module with exemplary two diagonal bars 6 and connecting pockets 4.

The terms plate, disc and shell used in the following explanations are used here in the sense of technical mechanics. Thus, it is defined that a plate is a flat component which is loaded by vertical forces and/or bending moments around the plane axes. A disc is therefore a flat area-covering structure which is loaded exclusively by forces in its plane. A shell (with the special case of a flat shell) is an area-covering structure that can support loads both vertically and in its plane.

In accordance with the invention, the area-covering structure module is designed with two shells.

The area-covering structure module according to the invention is achieved from an upper secondary shell element 1 and a lower secondary shell element 2, which are joined together by statically required crossbars to form a primary shell support structure with a truss support effect.

The area-covering structure module according to the invention is produced in the form of an octagonal convex polyhedron with twelve edges, formed from six quadrilaterals, which in the special case of an orthogonal design forms a cuboid. Two opposite planes are formed as areas, which form the upper and lower secondary shell elements 1 and 2, with crossbars 3 being installed along the four remaining edges and, after completion by statically required or functional diagonal rods 6 by connections at the corners of the upper and lower secondary shell elements 1 and 2 with adjacent modules, forming a double-shell area-covering structure in the form of a primary shell supporting structure with a single- or double-axis truss supporting effect, wherein the edges of the secondary shell elements 1 and 2 of adjacent area-covering structure modules adjoin each other.

The secondary shell elements 1 and 2 are components of several, for the most part identical, prefabricated area-covering structures (FIG. 1), which consist of the secondary shell elements 1 and 2 as well as 90° or approximately 90° to these crossbars 3.

In FIG. 1, a module is displayed in orthogonal form.

Other geometric forms also belong to the inventive idea. For example, a pyramid stump for the formation of two-axis curved primary shells is possible and appropriate.

The secondary shell elements 1 and 2 with appropriate ground plan dimensions are preferably or predominantly square, rectangular or trapezoidal. They are connected to each other at their corners by crossbars 3 of appropriate length and are spaced apart.

The crossbars 3 shown in the representation of FIG. 1 are formed from angle profiles which are fastened to the secondary shell elements 1 and 2 with screwed and/or welded connections.

In principle, other cross-sections or length-adjustable bars are also possible as crossbars 3.

The secondary shell elements 1 and 2 have a special design in accordance with FIG. 1 or Detail 1*a* with a connection pocket 4, open at the top or bottom or top and bottom in each corner, of an appropriate size, which is delimited at least on the outside, i.e. on the outside vertical areas of the secondary shell elements 1 and 2, by preferably metal profiles or metal sheets, and which have vertical outside areas with holes 5 when the screw connection is used.

For the construction of single- or double-axis load-bearing primary shell structures, which are used e.g. as building ceilings, the modules can be connected, for example according to FIG. 1, with screws through the holes 5 in both planes of the secondary shell elements 1 and 2.

To take up the transverse forces of the shell, diagonal bars 6, of which two rods are shown as examples in FIG. 1, installed according to static requirements and connected in further shearing areas with the same screws that also connect the modules.

These diagonal bars 6 also belong to the crossbars of the primary shell structure.

Figure 1A:
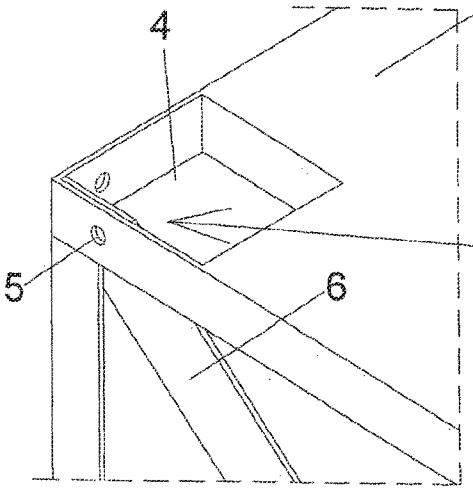
FIG. 1*a*: alternative detail to the connection of the diagonal bars 6 with gapless arrangement of the modules.
Figure 1B:
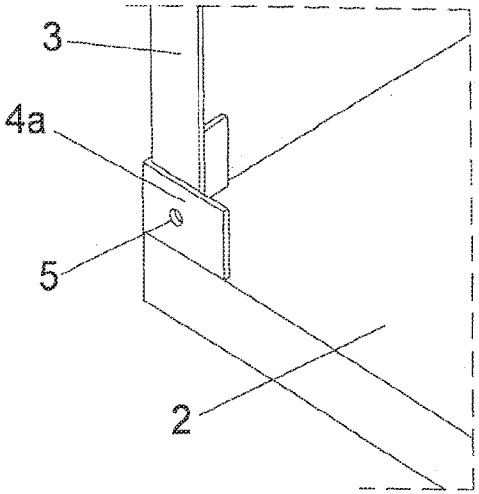
FIG. 1*b*: alternative detail with formation of connecting pockets 4 replacing connecting straps 4*a*.

The diagonal bars 6 can either be installed between the modules, as shown in the overall picture of FIG. 1 or—if the modules are arranged without spacing—one bar per module within the connection pockets 4, as shown in the alternative detail FIG. 1*a*.

When considering the direction of installation, it must be taken into account that only tensile forces are generated in the diagonal bars 6.

If significant compressive forces occur in the diagonal bars 6, cross-sections with greater buckling stability such as angle profiles must be used.

In a further special version of the solution according to the invention, the connecting pockets 4 can be arranged according to detail 1*b* to replace connection pieces 4*a*.

These connection pieces 4*a* are formed by angular surfaces projecting in the direction of the space between the secondary shell elements 1 and 2, preferably made of metal sheets in the corners of the secondary shell elements 1 and 2.

Hole 5 to be used for connecting several primary shell elements is also arranged in this special configuration in the connection pieces 4*a*.

When using the connection pieces 4 *a*, the connections of the secondary shell elements 1 and 2 and of the crossbars 3 and the diagonal bars 6 on the secondary shell elements 1 and 2 are located outside these secondary shell elements 1 and 2, so that a continuous area is formed by the area-covering structure modules.

When using the connecting pockets 4, this area shows, according to FIG. 1 and Detail 1*a*, the recesses formed by connecting pockets 4, which are to be closed or covered later.

Figure 2:
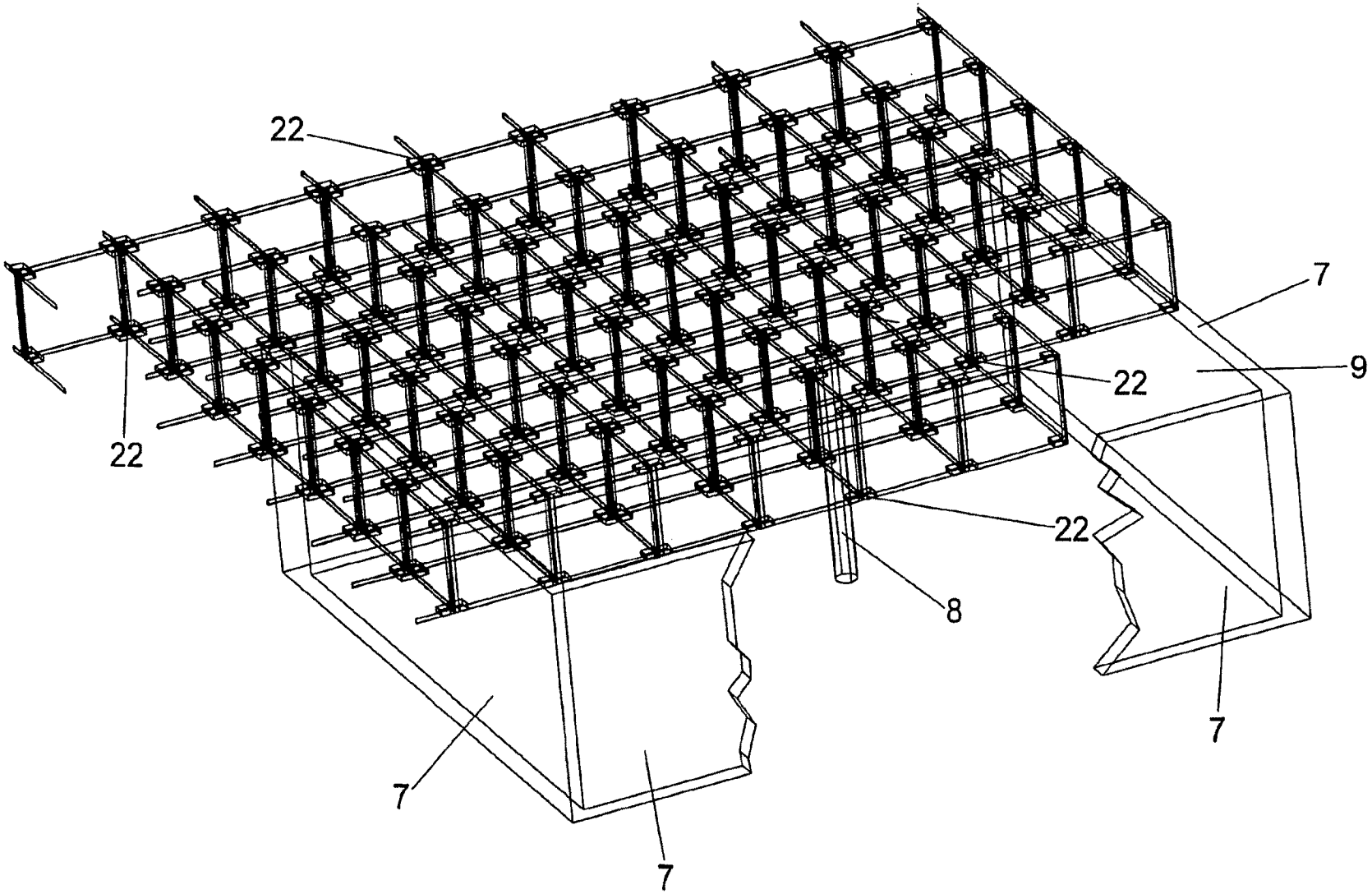
FIG. 2: example of a ceiling structure with skeleton-like transparent representation of the secondary shell elements 1 and 2 without representation of the diagonal bars 6.

FIG. 2 shows a section of an example of a primary shell supporting structure formed from individual modules according to FIG. 1 in ceiling use with linear supports on walls 7, an individual support 8 and a recess 9, whereby, for better understanding, the secondary shell elements 1 and 2 are shown in a skeleton-like like and transparent manner and, for better clarity, the diagonal bars 6 have been omitted.

Figure 3:
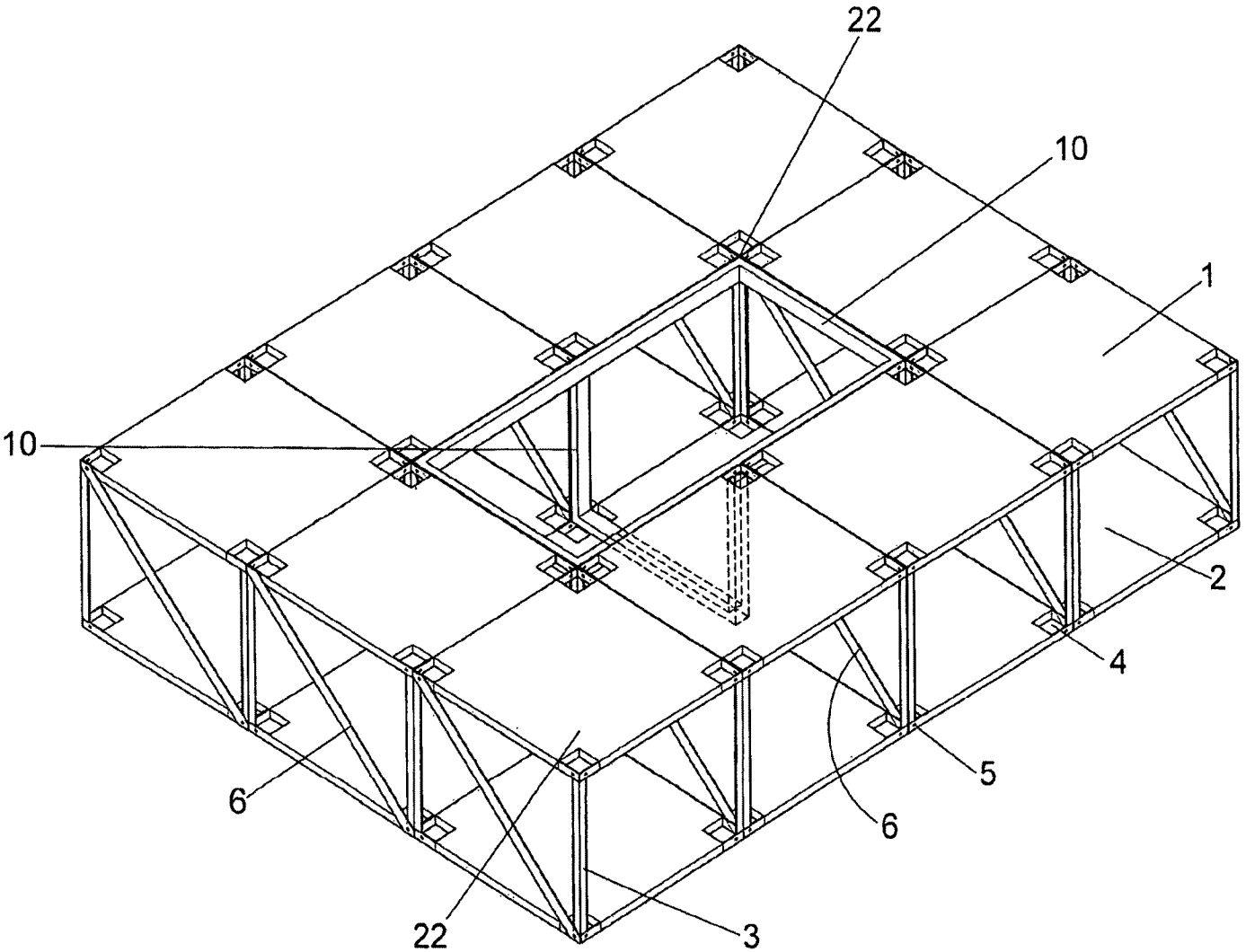
FIG. 3: replacement of rods 3 and 6 by subframes 10.

In cases or places where the installation of bars 3 and 6 or areas of secondary shell elements 1 and 2 obstructs the desired use of the space between the shells, subframes 10 according to FIG. 3 can be installed.

This basically leads to a spatial primary shell structure with a multi-axial truss load-bearing effect, in which the secondary shell elements 1 and 2 and transmit the local, vertical loads as plates and take up the truss forces in both orthogonal load-bearing directions as discs.

The horizontal stiffening loads, e.g. from wind and structural imperfections of the building, are transferred to the stiffening walls, the case of ceiling use, via the primary shell structure.

The primary shell supporting structure can be supported at any reasonable points at module node 22, which are located at the corners of the secondary shell elements 1 and 2, e.g. by walls 7 or individual columns 8.

Figure 4B:
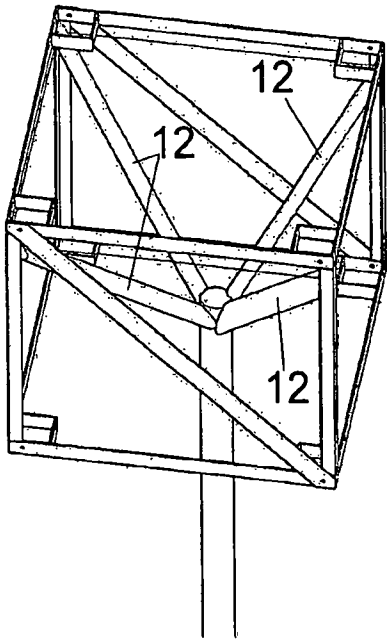
FIGS. 4*a*, 4*b*, 4*c*: load dissipation for columns which are not directly under a module node with transparent skeleton-like representation of the secondary shell elements.
Figure 4A:
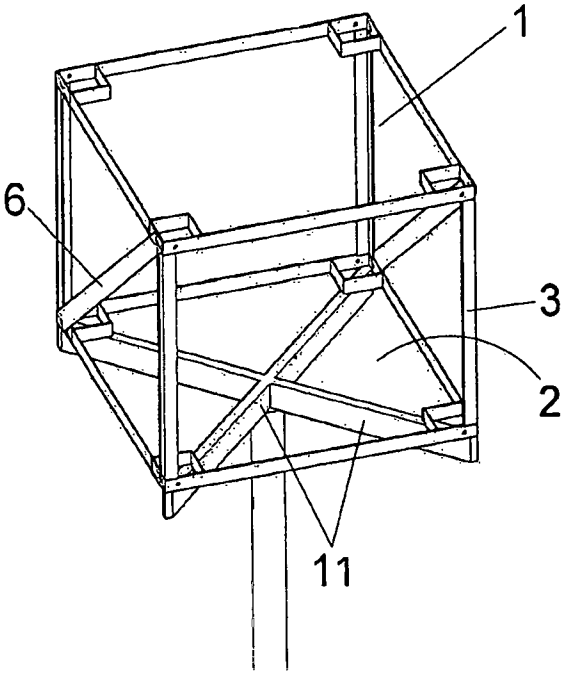
Figure 4C:
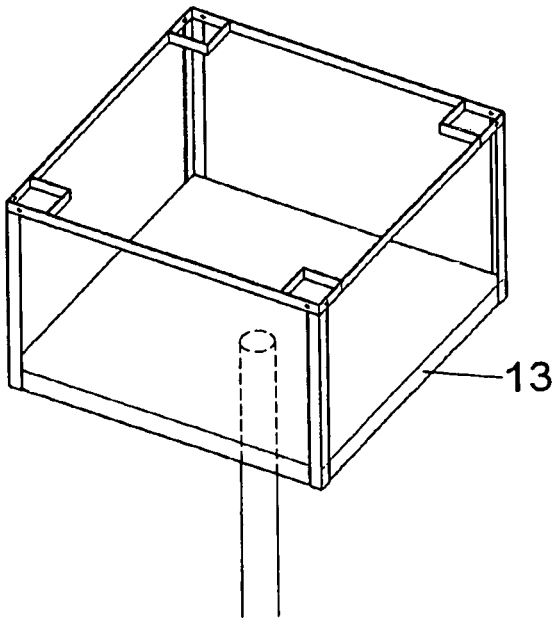

If supports are desired or required which are not directly located at module node 22, the additional cross beams 11 shown in FIG. 4*a*, 4*b*, 4*c* according to FIG. 4*a*, diagonal struts 12 can be added to the upper module corners according to FIG. 4*b* or reinforcements 13 of the lower secondary shell elements 2 according to FIG. 4*c*, which transfer the support load to the adjacent module nodes 22.

In new buildings, the dimensional grid of the ceiling corresponds to the basic grid of the building. For the installation in existing buildings, fitting modules may have to be manufactured if required.

Figure 5:
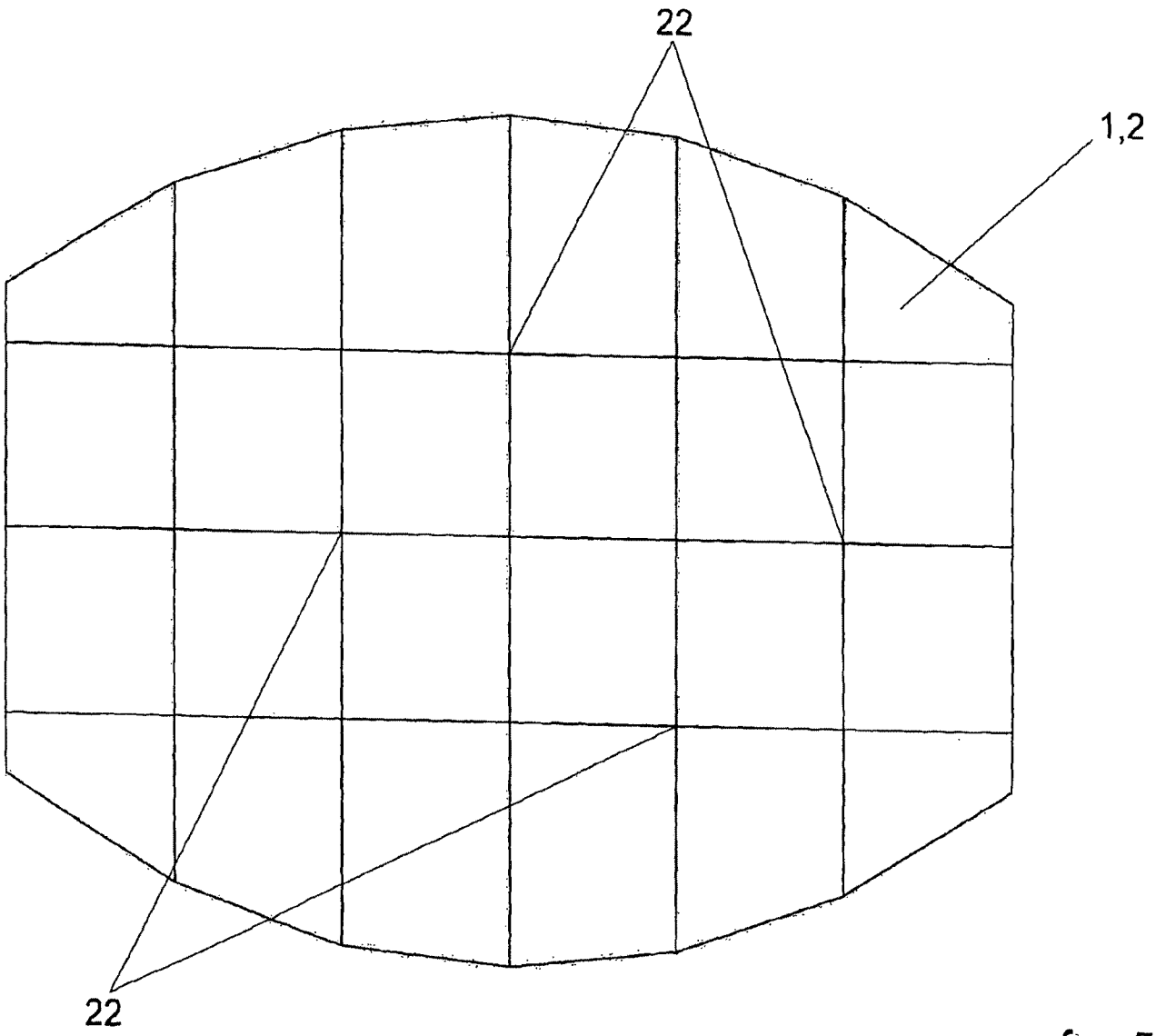
FIG. 5: schematic plan view of a possible formation of a primary shell structure with partly trapezoidal secondary shell elements 1 and 2 for the formation of non-linear edged surfaces.

In a special design of the solution in accordance with the invention, trapezoidal secondary shell elements 1 and 2 can also be used to support primary shell structures that are not bordered in a straight line (FIG. 5) be produced.

The use of secondary shell elements 1 and 2 with unequal areas, e.g. in the formation of the modules in the geometric shape of a pyramid stump, permits the production of two-axis curved primary shell structures.

Figure 6:
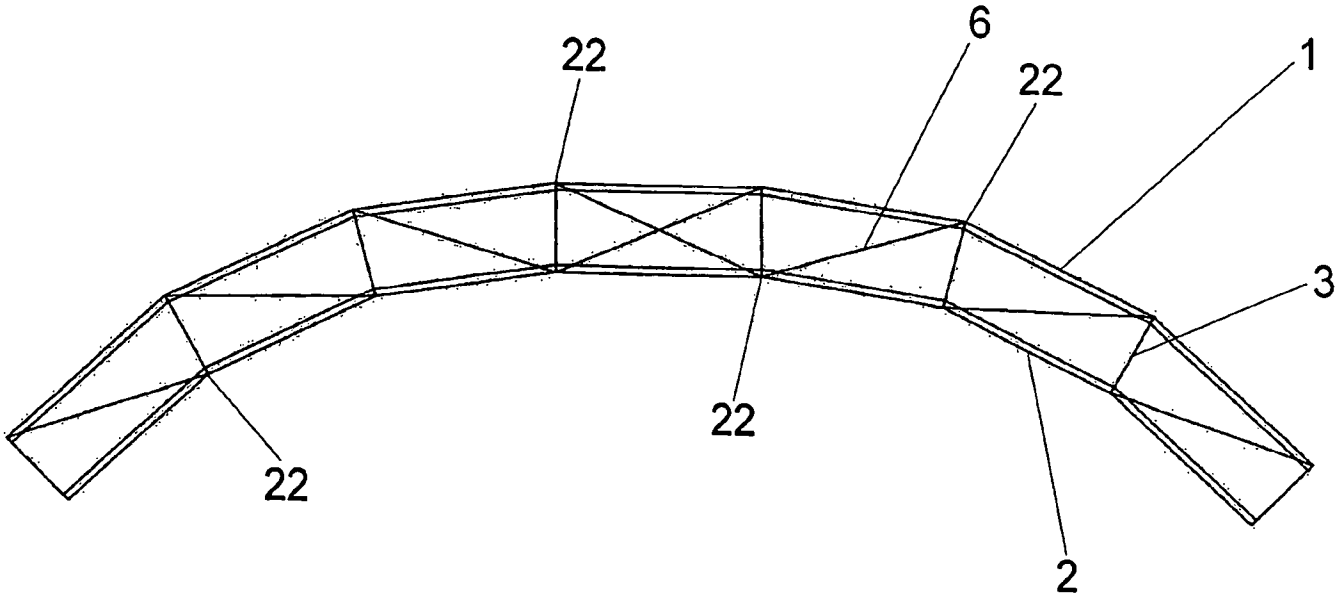
FIG. 6: schematic cross-section of a possible formation of a single-axis curved primary shell structure.
Figure 7:
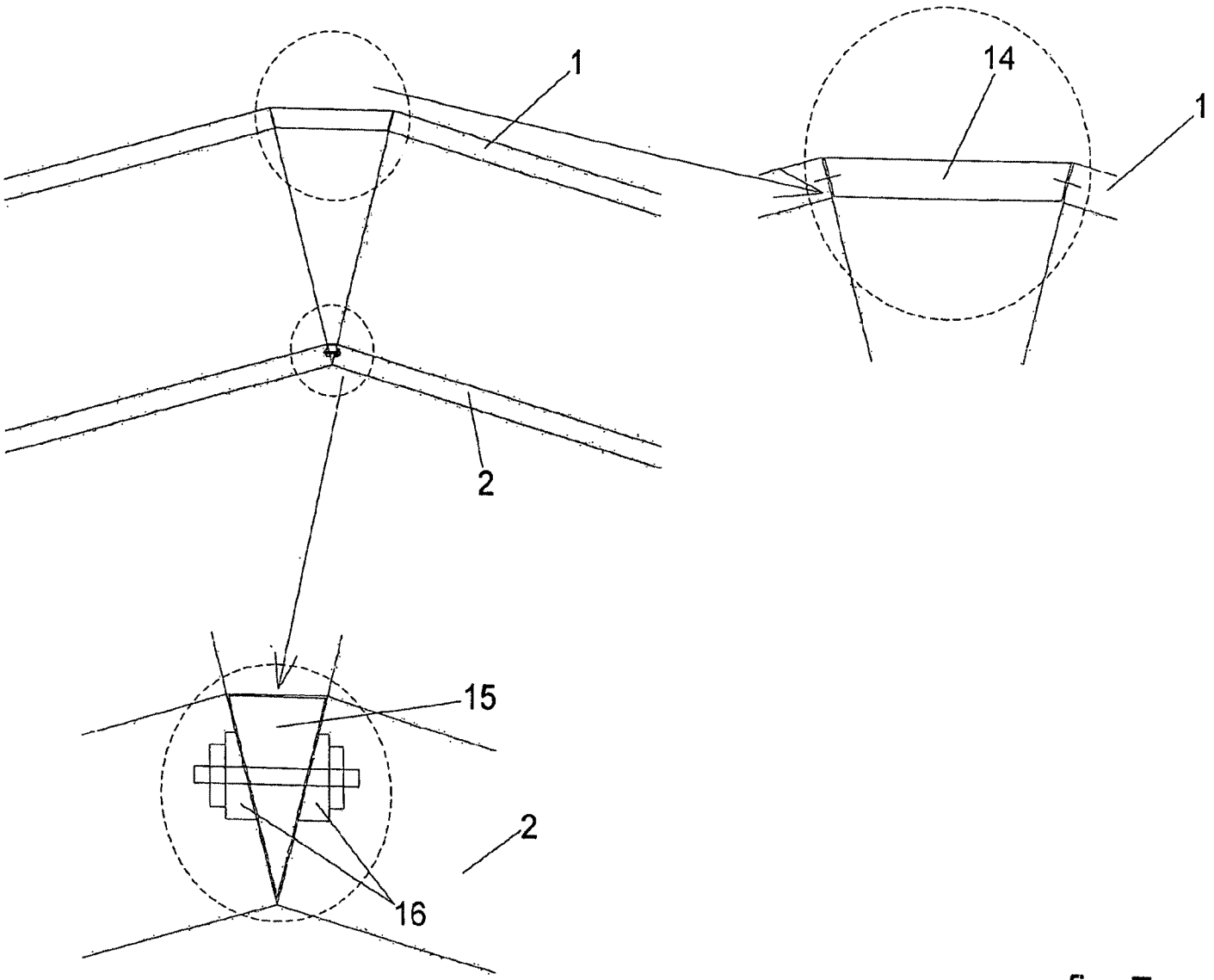
FIG. 7: schematic cross-section of a possible formation of a single-axis curved primary shell structure by installing spacer plates 14 and adapter wedges 15 with corresponding wedge disks 16 for the screw connections.

FIG. 6 shows an example of a cross-section through a single-axis curved primary shell structure. Curves of primary shell structures can be implemented by using orthogonal modules (FIG. 1) also by installing spacer plates 14 and adapter wedges 15 with corresponding wedge discs 16 for the screw connections (FIG. 7).

s Small curves of primary shell structures, which e.g. can be used to compensate deformations due to loads or low drainage gradients with flat roofs, can also be produced by inserting spacers in the appropriate screw connections of the modules according to FIG. 1.

By different formations and/or materials of the secondary shell elements 1 and 2, these can be adjusted to different, e.g. regarding load capacity, fire protection, sound insulation, thermal insulation, lightweight construction.

The space between the secondary shell elements 1 and 2 can be used for building services installations, which can be easily extended, reduced, repaired, cleaned or dismantled, as well as for insulation levels.

If, with appropriate ceiling use of the area-covering structure module according to the invention, heating or refrigerant pipes are integrated into the secondary shell elements 1 and 2, heating can be achieved from the floor (secondary shell element 1) and cooling from the room ceiling (secondary shell element 2), whereby high energy efficiency and comfort are achieved.

Future new developments in building services engineering (heating, ventilation, sanitation, electrical installation, communication) can then also be installed subsequently, which considerably increases the sustainability of the buildings equipped with the double-shell area-covering structure.

In addition, a major contribution to the efficient use of space can be made by, for example, lowering or lifting furniture that is not in permanent use into the level between the secondary shell elements 1 and 2 while they are not used.

Figure 8:
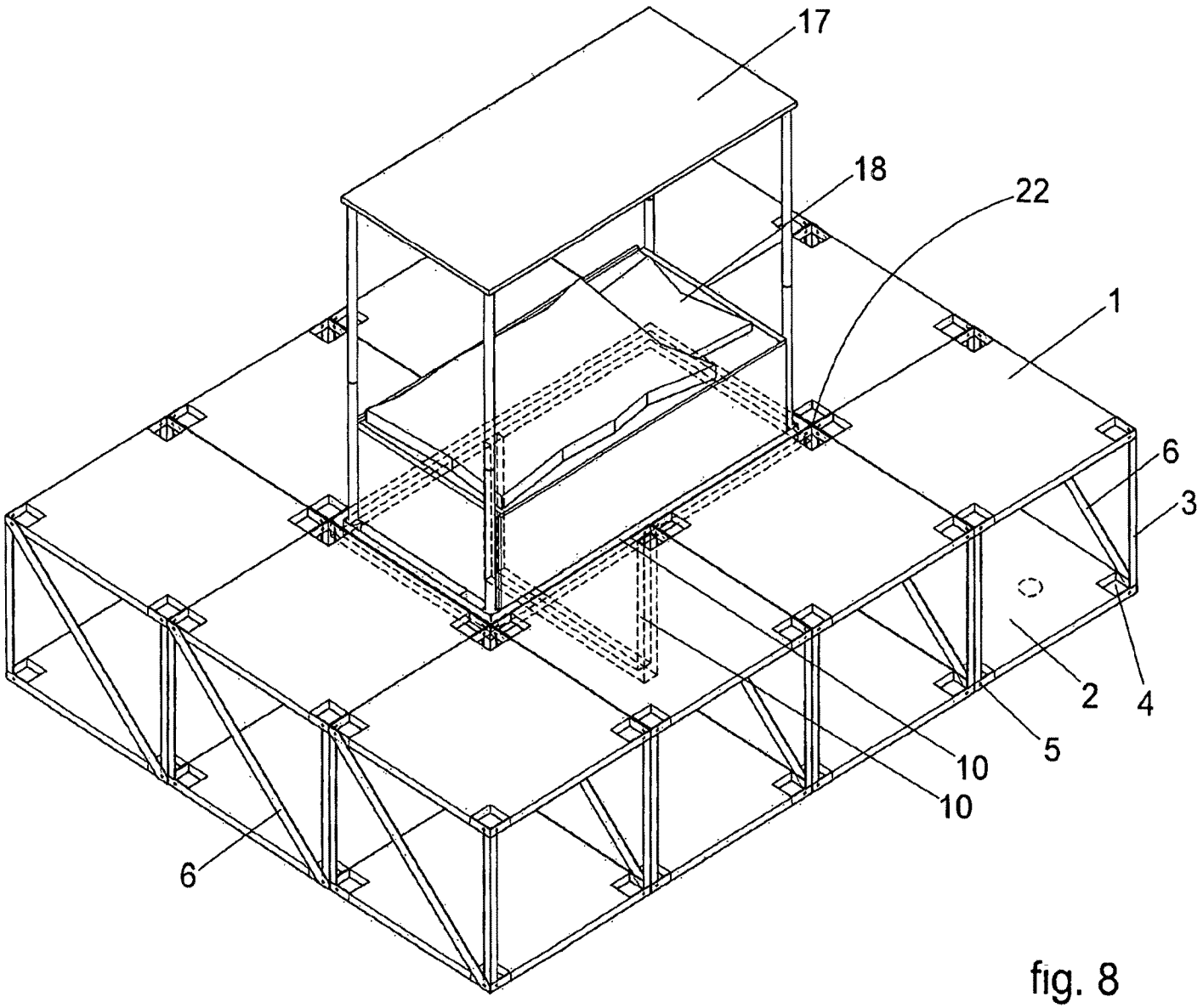
FIG. 8: as FIG. 3 with bed lifted out of the gap 18.

As an example, a possibility is given to move a table 17 used during the day upwards in the evening to use the same area for a bed 18 raised from the floor, as shown in FIG. 8.

Table 17 and bed 18 are moved vertically by hydraulic or pneumatic cylinders, electric linear drives or telescopic supports with worm/screw drives or internal rope/roller systems.

Likewise, rails can be installed in the intermediate level at which or on which stowage containers are moved, which are made accessible through one or more openings in one of the secondary shells.

Figure 9:
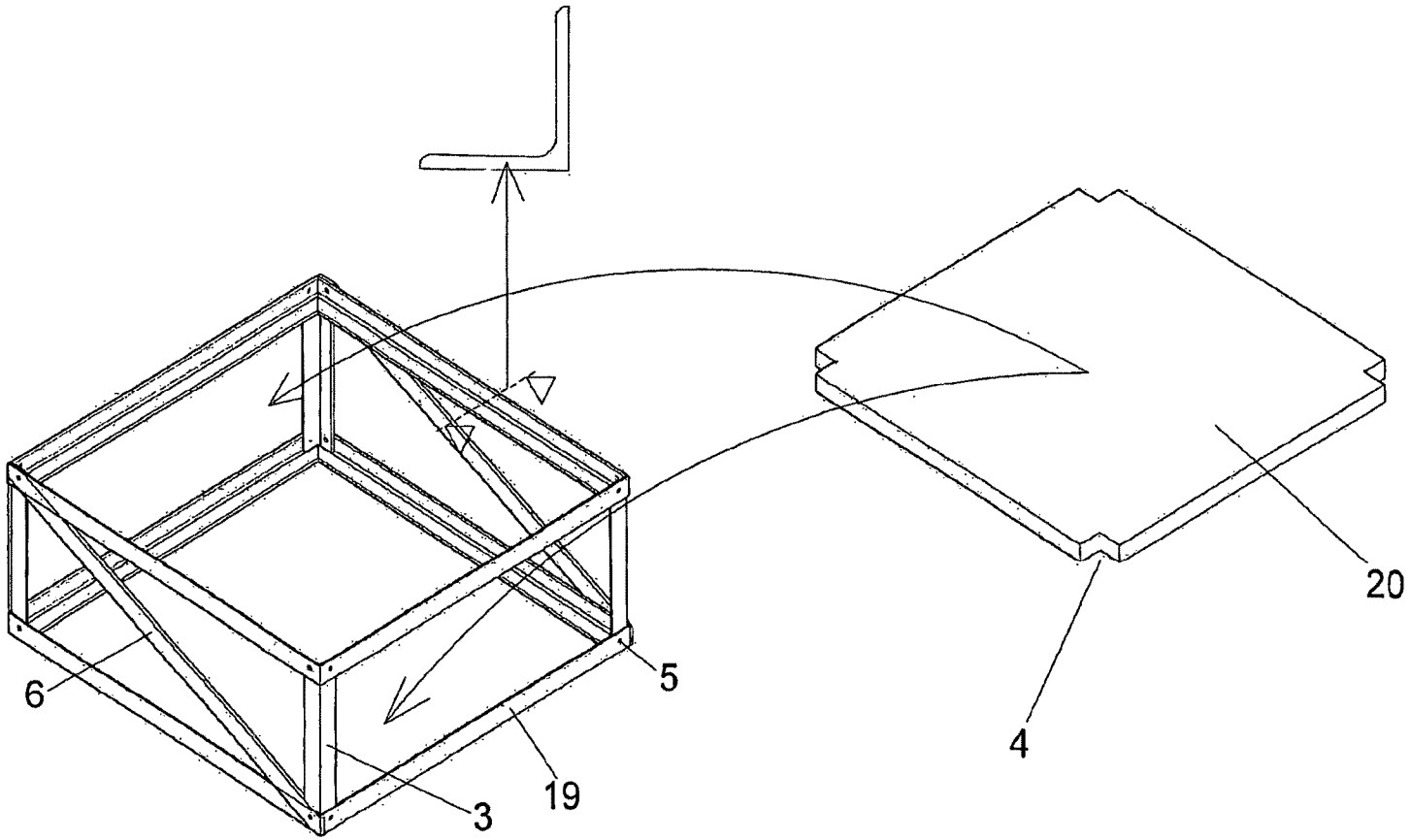
FIG. 9: as FIG. 1 with shell elements with circumferential angle profile frame 19 with inlaid plates 20.

If a distance between the two secondary shell planes is chosen that no longer allows direct access to the space between them, the secondary shell elements 1 and 2 should be at least partially accessible as shown in FIG. 9 with circumferential frames made of angle profiles 19, on the lower horizontal legs of which plates 20 with recesses in the corners made of suitable materials are removably inserted, the lateral edges of which should be fitted with pressure contact to the vertical angle legs to ensure the pane effect.

When using connection pieces 4*a* instead of connection pieces 4, the recesses in the corners of the plates 20 can be omitted.

Figure 10:
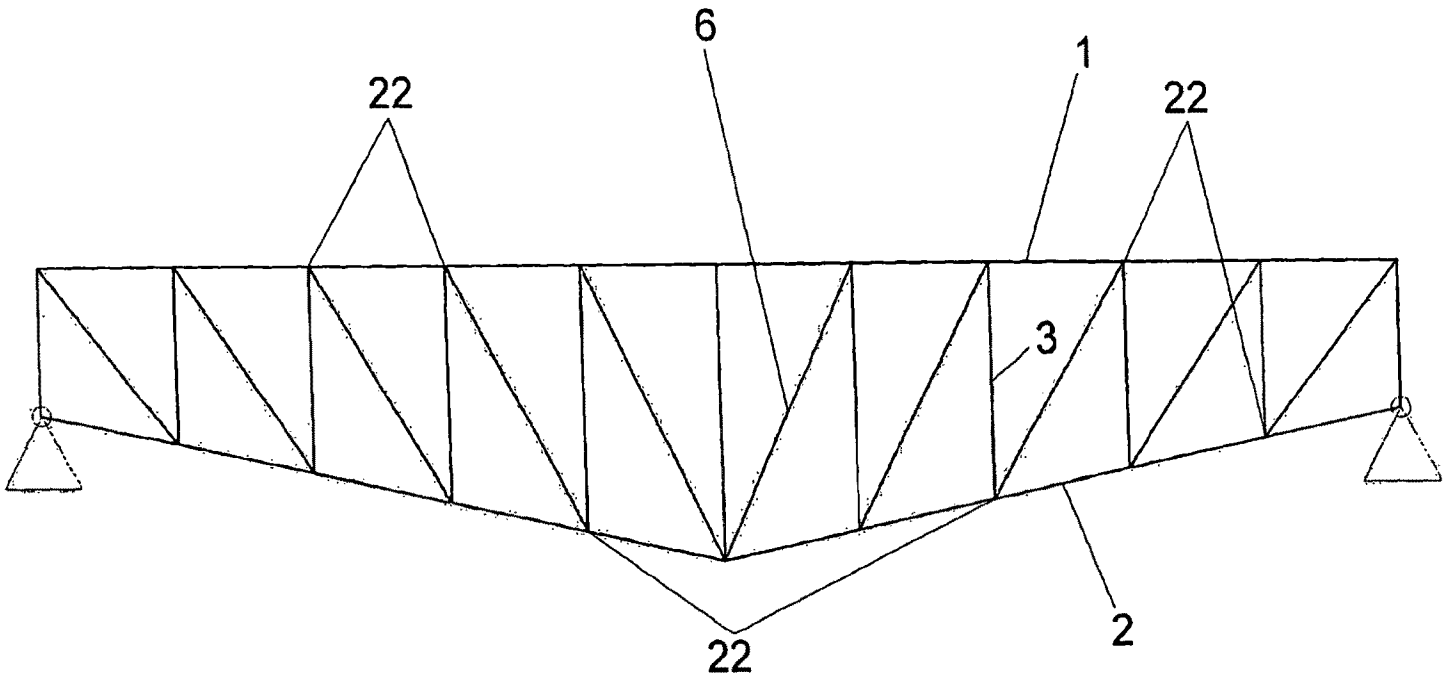
FIG. 10: schematic cross-section of a possible formation of the surface structures with variable spacing of the secondary shell elements 1 and 2.

It is also possible to manufacture the described modules not exclusively with parallel secondary shell elements 1 and 2, but to adjust the spacing of the secondary shell elements 1 and 2 to the bending loads (FIG. 10).

The advantages of the area-covering structure according to the invention are particularly evident when used in a horizontal position, e.g. as a building ceiling.

Figure 11:
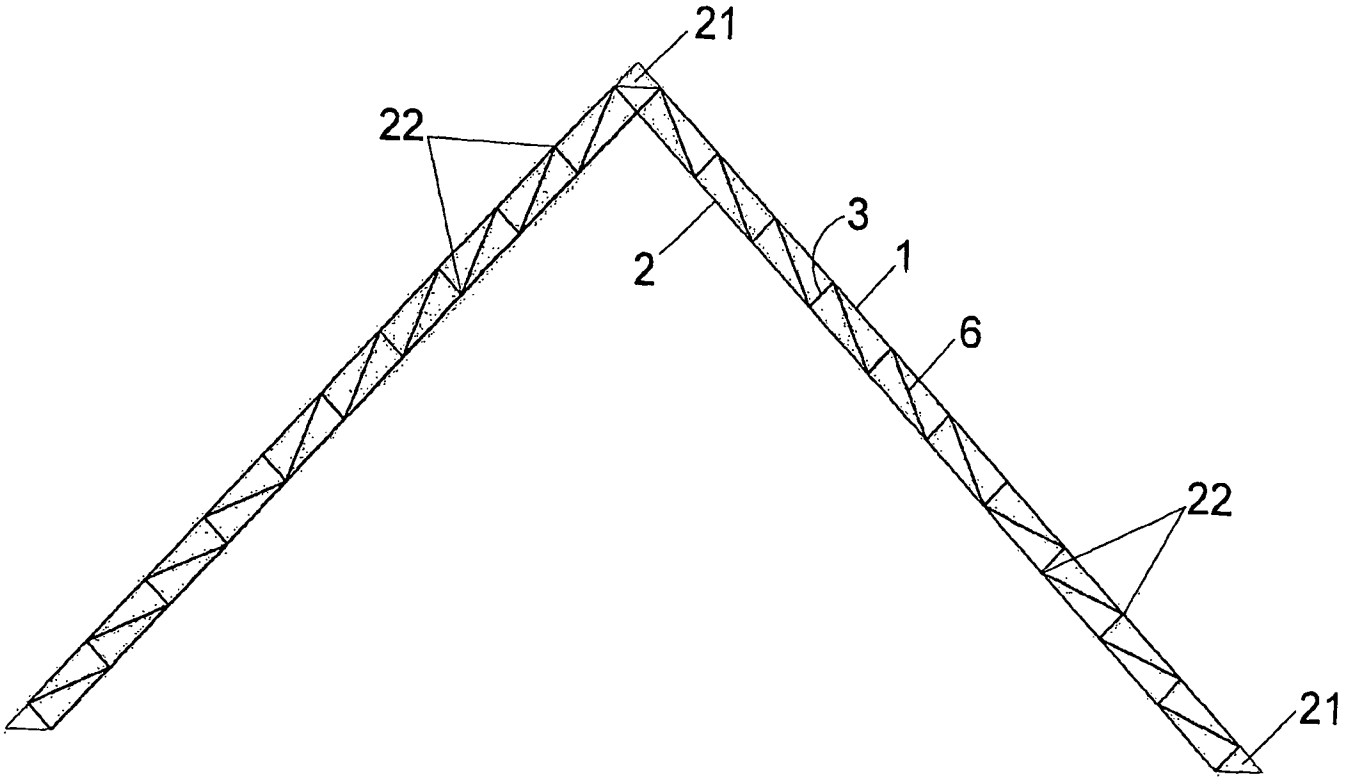
FIG. 11: schematic cross section of a possible inclined arrangement of the area-covering structures, formed by the secondary shell elements 1 and 2 as well as crossbars 3 and 6, as a saddle roof with adapter elements 21 at the eaves and at the ridge.

However, it can also be used, for example, in an inclined position to form saddle or pent roofs with adapter elements 21 at the eaves and ridge (FIG. 11) or in a vertical position, i.e. as a wall.

A further advantage of the area-covering structure described here, compared to previously known structures, is that it can be economically manufactured in a wide variety of geometries and installed in buildings of different construction methods by joining together largely identical areas that are industrially prefabricated in series and, if required, partly pre-assembled as well as easy to transport and assemble.

In addition, the fact that the use of the area-covering structure described here is not limited to horizontal primary shell supporting structures is to be regarded as an advantage.

Due to the sensible use of the secondary shell elements 1 and 2 as plates and discs, the overall potential of the load capacities of the components is exploited to a much greater extent than with conventional designs.

In the case of rod-shaped components such as crossbars 3 and frame angle profiles 18, stability failure can be prevented or delayed by simple means under high compressive forces. This leads to a significantly more favourable ratio between the dead load of the construction and the possible payload.

REFERENCE CHARACTER LIST

1 Upper secondary shell element
2 Lower secondary shell element
3 Crossbar
4 Connecting pocket
4A Connection piece
5 Holes in 4 or 4*a*
6 Diagonal rod
7 Supporting wall
8 Single support
9 Recess
10 Subframe
11 Cross beam
12 Diagonal strut
13 Reinforcement of 2
14 Spacer plate
15 Adapter wedge
16 Wedge disc
17 Table
18 Bed
19 Angle profile
20 Plate on 19
21 Adapter elements
22 Module nodes

The invention claimed is:

1. A double-shell area-covering structure module, comprising:

a structure forming an octagonal convex polyhedron including six quadrilaterals and twelve edges and forming a cuboid in an orthogonal configuration having two opposite planes formed as areas representing mutually spaced apart upper and lower secondary shell elements configured be used directly and without further load distribution or compensation layers; and crossbars being fitted along four remaining edges and supplemental statically required or functional diagonal rods forming a double-shell area-covering structure having connections at corners of said upper and lower secondary shell elements with adjacent modules, forming a primary shell supporting structure with a single-axis or double-axis truss effect having edges of secondary shell elements of adjacent area-covering structure modules being adjacent one another and serving to accommodate installations and to temporarily accommodate and move furnishings and fittings between said upper and lower secondary shell elements;

said upper and lower secondary shell elements being at least partially equipped with circumferential frames formed of angle profiles and plates disposed on lower horizontal legs of said angle profiles, said plates having recesses in corners for forming connecting pockets or additionally disposed connection pieces of suitable materials being removably inserted, and said plates having lateral edges inserted in pressure contact with vertical angles of said lower horizontal legs of said angle profiles.

2. The area-covering structure module according to claim 1, wherein said crossbars disposed at 90 degrees or approximately 90 degrees relative to said upper and lower secondary shell elements and diagonal bars for taking up transverse shell forces together define filler bars.

3. The area-covering structure module according to claim 1, which further comprises sub frames to be inserted in said space between said upper and lower secondary shell elements.

4. The area-covering structure module according to claim 1, which further comprises module nodes on which the double-shell area-covering structure forming said primary shell supporting structure is supported at desired locations, and linear supports, walls or individual supports at corners of said upper and lower secondary shell elements.

5. The area-covering structure module according to claim 1, which further comprises adjacent module nodes, supports not disposed directly at said module nodes, and additional cross beams, diagonal struts leading to upper module corners or reinforcements of said lower secondary shell elements deflecting a support load onto said adjacent module nodes.

6. The area-covering structure module according to claim 1, wherein said upper and lower secondary shell elements are trapezoidal for construction of non-linearly edged double-shell area-covering structures forming said primary shell supporting structures.

7. The area-covering structure module according to claim 1, which further comprises pyramid-shaped truncated modules for production of said primary shell supporting structures having a two-axis curve.

8. The area-covering structure module according to claim 1, which further comprises orthogonal modules with spacer plates, adapter wedges and wedge discs adapted to an intended curve for construction of bends in double-shell area-covering structures forming said primary shell supporting structures.

9. The area-covering structure module according to claim 1, which further comprises rails disposed in said space between said upper and lower secondary shell elements for storage containers being accessible through one or several openings in one of said upper and lower secondary shell elements and movable on said rails over an area of said primary shell supporting structure.

10. A primary shell support structure comprising: two shell surface support structure modules each of which including a respective structure in a form of an octagonal, twelve-edged, convex polyhedron defined by six quadrilaterals, in which opposing faces are provided as surfaces defining upper and lower secondary shell elements, said upper and lower secondary shell elements being spaced apart from each other and cross members being installed along four remaining edges and diagonal members installed by connection to corners of said upper and lower secondary shell elements;

adjacent edges of said upper and lower secondary shell elements of each of said surface support structure modules abutting each other and defining a two-shell surface support structure provided as a primary shell support structure with a single-axis or double-axis truss effect being defined, a space between said upper and lower secondary shell elements defining an installation or storage space;

sub-frames provided in said space between said upper and lower secondary shell elements for taking on a function of said cross and diagonal members in areas in which said cross and diagonal members prevent a use as said installation or storage space, rails being arranged in said space between said upper and lower secondary shell elements, said rails being configured for storage containers to be moved thereon, said upper and lower secondary shell elements having one or more openings are formed therein for accessing the storage containers.

11. The primary shell support structure according to claim 10, wherein said upper and lower secondary shell elements have, in each corner, a connecting pocket open at the top or bottom or at the top and bottom, having an appropriate size to connect a plurality of surface support structure modules to one another, and having stable and mechanically loadable edges at least on outer vertical surfaces of said upper and lower secondary shell elements.

12. The primary shell support structure according to claim 10, in which the upper and lower secondary shell elements have respective connecting plates in each corner defined by angular surfaces that project in a direction of said intermediate space between said upper and lower secondary shell elements, said connecting plates have holes formed therein.

13. The primary shell support structure according to claim 10, wherein locations on module vertices at the corners of the upper and lower secondary shell elements are supported by linear supports that include walls or individual supports.

14. The primary shell support structure according to claim 13, which further comprises adjacent module nodes, supports not disposed directly at said module nodes, and additional cross beams, diagonal struts leading to upper module corners or reinforcements of said lower secondary shell elements deflecting a support load onto said adjacent module nodes.

15. The primary shell support structure according to claim 10, wherein said upper and lower secondary shell elements are trapezoidal for construction of non-linearly edged double-shell area-covering structures forming said primary shell supporting structures.

16. The primary shell support structure according to claim 10, which further comprises pyramid-shaped truncated modules for production of said primary shell supporting structures having a two-axis curve.

17. The primary shell support structure according to claim 10, which further comprises orthogonal modules with spacer plates, adapter wedges and wedge discs configured to an intended curve for construction of bends in double-shell area-covering structures forming said primary shell supporting structures.

18. The primary shell support structure according to claim 10, wherein after formation or modification of the primary shell support structure, equipment not currently in use can be lowered into or lifted out of the space between the upper and lower secondary shell elements when not in use.

19. The primary shell support structure according to claim 10, wherein said upper and lower secondary shell elements are at least partially equipped with circumferential frames formed of angle profiles and plates disposed on lower horizontal legs of said angle profiles, said plates having recesses in corners for forming connecting pockets or additionally disposed connection pieces of suitable materials being removably inserted, and said plates having lateral edges inserted in pressure contact with vertical angles of said lower horizontal legs of said angle profiles.

20. The primary shell support structure according to claim 10, wherein the edges are orthogonal to define a rectangle.

* * * * *